US006004505A

United States Patent [19]

Roy et al.

[11] Patent Number: 6,004,505

[45] Date of Patent: Dec. 21, 1999

[54] PROCESS AND APPARATUS FOR THE PREPARATION OF PARTICULATE OR SOLID PARTS

[75] Inventors: Rustum Roy; Dinesh Agrawal; Jiping Cheng, all of State College, Pa.; Mahlon Dennis, Kingwood, Tex.; Paul D. Gigil, Lemont, Pa.

[73] Assignees: Dennis Tool Corporation, Houston, Tex.; The Penn State Research Foundation, University Park, Pa.

[21] Appl. No.: 08/687,870

[22] Filed: Jul. 26, 1996

[51] Int. Cl.[6] ..... B22F 3/10

[52] U.S. Cl. ..... 419/6; 419/7; 419/10; 266/287; 219/678; 219/756

[58] Field of Search ..... 419/2, 38, 6, 7, 419/10; 266/287; 219/678, 756

[56] References Cited

U.S. PATENT DOCUMENTS

| | | | |
|---|---|---|---|
| 4,501,717 | 2/1985 | Tsukamoto et al. | 419/58 |
| 4,760,228 | 7/1988 | Kudo | 219/10.55 A |
| 4,938,673 | 7/1990 | Adrian | 419/23 |

OTHER PUBLICATIONS

The Inhibition of WC Grain Growth During Sintering of nanostructured WC–Co Powder Compacts, L.E.McCandlish, P. Secgopaul and R.K. Sadangik, Nanodyne Incorporated, 19 Home News Row, New Brunswick, NJ.

Microwave Processing of Ceramic Materials, Willard H. Sutton, United Technologies Research Center, East Hartford, CT, Ceramic Bulletin, vol. 68 o. 2, 1989.

Microwave Sintering of Multiple Alumina and Composite Components, Joel D. Katz and Rodger D. Blake, Los Alamos National Laboratory, Los Alamos, New Mexico, Ceramic Bulletin , Bol. 70, NOP. 9, 1991.

*Primary Examiner*—Daniel J. Jenkins

*Attorney, Agent, or Firm*—Gunn & Associates, P.C.

[57] ABSTRACT

The present disclosure is directed to a method of converting green particles to form finished particles. The apparatus used for sintering incorporates an elongate hollow tube, an insulative sleeve there about to define an elevated temperature zone, and a microwave generator coupled through a wave guide into a microwave cavity incorporated the tube. The particles are moved through the tube at a controlled rate to assure adequate exposure to the microwave radiation. Another form sintered a solid part in a cavity or mold.

32 Claims, 5 Drawing Sheets

FIG. 2
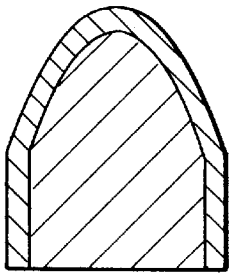
FIG. 3
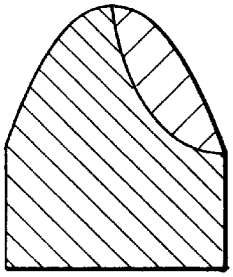
FIG. 4
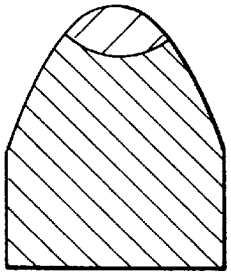
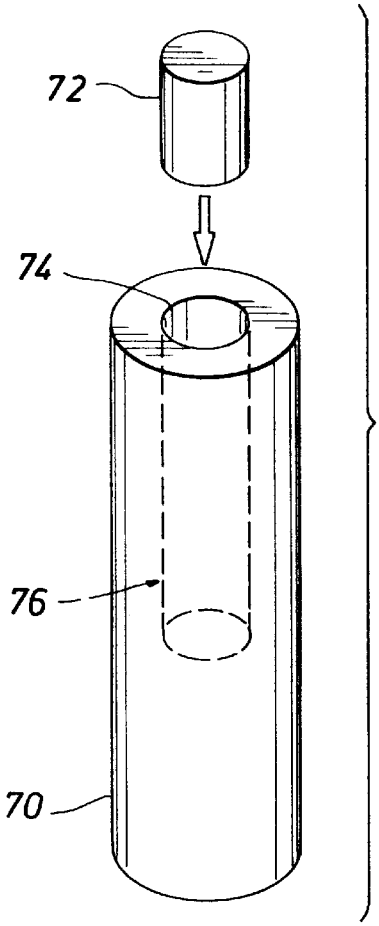
FIG. 5

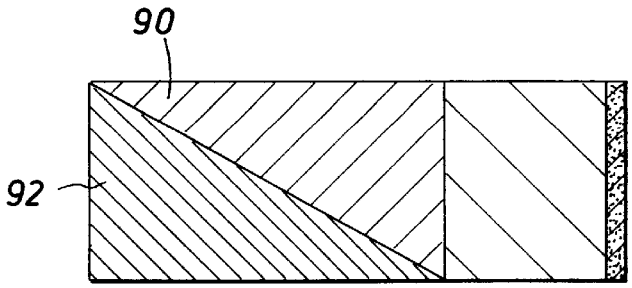
FIG. 10
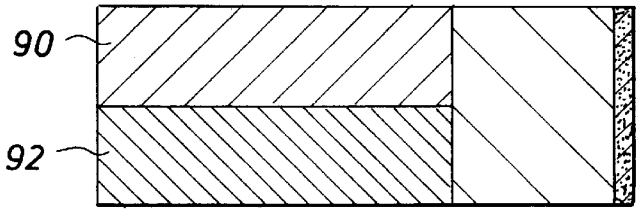
FIG. 11
FIG. 12
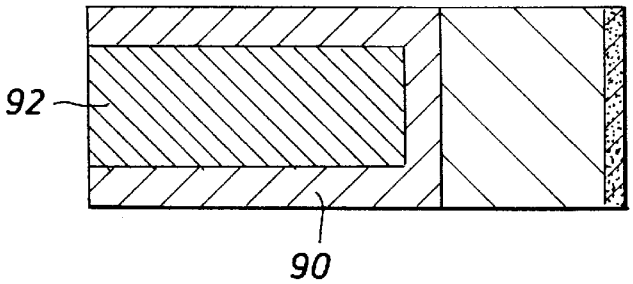
FIG. 13
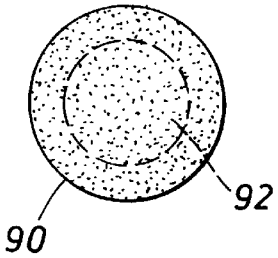
FIG. 14
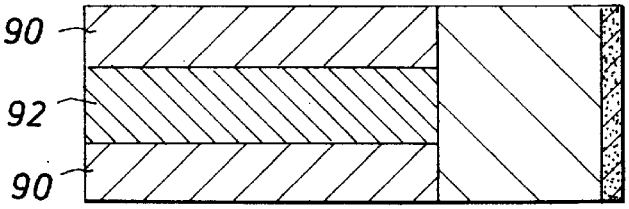
FIG. 15
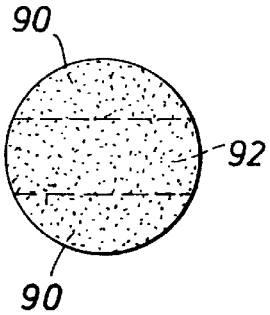

PROCESS AND APPARATUS FOR THE PREPARATION OF PARTICULATE OR SOLID PARTS

BACKGROUND OF THE DISCLOSURE

Microwave heating has demonstrated itself to be a powerful technique for sintering various ceramics, especially through the past decade. Microwave heating may decrease the sintering temperatures and times dramatically, and is economically advantageous due to considerable energy savings. However, one of the major limitations is the volume and/or size of the ceramic products that can be microwave sintered because an inhomogeneous microwave energy distribution inside the applicator which often results in a non-uniform heating. Considerable research has gone into making microwave sintering technology commercially viable.

This disclosure sets forth three different types of products which can be handled by microwave heating to obtain sintering. The three different types of products refers to the form of the products, not the chemical makeup of the products. Indeed, the products can be made of the same constituent ingredients. They differ however primarily in the shape and hence the cohesive nature of the respective products.

The three product formats or forms include loose particulate material, i.e., a powder of a specified size, a molded product or a precast molded product. The distinction in the latter is that it is precast sufficiently that it requires no mold during sintering. It can be precast with a sacrificial wax or other adhesive which glues the particles together into a precast form. During sintering, the form is not changed in terms of shape, but the form is sustained although this is accomplished free or devoid of a confining mold. The molded product is a product which is held in a mold during sintering. One of the advantageous aspects of the molded products is that initial mold shaping of the particles making up the product can be accomplished at very low temperatures and pressures, i.e., substantially at room temperature and atmospheric pressure. Typically, a set of particles are joined in a mold again by a sacrificial wax or other material or alternately by the confines of the cavity mold itself. In either instance, the finished product is a structure which is sintered and yet which has a defined shape or profile. Examples abound as will be set forth below.

In all instances, it will be described so that the sintering process begins or acts on what are known as green materials. The term green materials refers to those which have been provided but have not been sintered. For particulate matter, they typically have the form of powders. Both in the molded and precast forms, one of the beginning materials is the requisite quantity of particles prior to molding, i.e., shaping into a desired form either by precast molding or sintering in a mold.

The preparation of loose material which is sintered defines small particles which can be used later in abrasive wheels and the like. Normally, these materials must be sintered to a specified grain size. In many applications, the quality or performance of the material is directly impacted by the grain size accomplished in the sintering process. In one aspect, grain size has an undesirable impact on the finished product. More specifically, this arises from the fact that additives often are placed in control quantities in the material prior to sintering so that the grain boundaries are defined by the additives. While there are additives available which do control grain size, the additives weaken or reduce the hardness of the finished product. Therefore such additives, while desirable in one aspect, are not desirable in other regards. The amount, nature, and dispersal of such grain boundary additives is a material factor, thereby providing a balanced mix of properties where the properties themselves result in some kind of compromise in the design of such sintered products. Effectively, grain boundary size is controlled only at a cost in sintered particle hardness.

Continuous microwave sintering of alumina is newly developed. One aspect of the continuous microwave sintering furnace is shown in FIG. 1. The microwave applicator is designed to focus the microwave field in the central area as uniformly as possible. A long cylindrical ceramic hollow tube contains the unsintered (or green) material which is fed into the microwave applicator at a constant feed speed. As the green material enters the microwave cavity, it is heated and gradually sintered while passing through the microwave zone. The heating rate, sintering time and cooling rate are controlled by the input microwave power, the feeding speed, and the thermal insulation surrounding the heated material. The ceramic hollow tube is also rotated during processing for uniform and homogeneous heating. As the green material passes through the high temperature zone, the particles are sintered entirely. Since the ceramic hollow tube is moved continuously in the axial direction during the processing, there is virtually no limitation to the length or volume of the product that can be processed by this technique. Consequently, it is, possible to scale up the volume of the ceramic products to be microwave sintered by this technique by implementing a continuous process.

This disclosure proves the continuous microwave sintering technique for small or large quantities of green material to make a desired shape or volume of material. The results show better physical properties than the conventionally processed material. The disclosure sets out three different product configurations. One form is a loose, unconsolidated particulate product, a second comprises a cold press shaped or configured particulate body shaped by a mold at minimal pressure, and a third form is a cold pressed, unconfined form of sufficient strength to hold its own shape. The three products are generally referred to below as sintered particles, molded products and precast products.

This disclosure is directed to a novel synthesis method for the manufacture of finished ceramics and/or ceramic/metallic composites utilizing the newly developed microwave processing. The process offers a faster, energy efficient route to manufacture extra hard products. Sintered particles prepared by this method exhibited greater micro Vickers hardness, even as much as 1500 kg/mm$^2$, better crystalline uniformity and average grain size less than sintered materials processed in the conventional manner. One aspect of this invention relates to improved preparation of parts made of nitrides, carbides, and similar hard materials.

The present disclosure sets forth a sintering apparatus which can be used for sintered particles or for cast items (molded or precast). Examples will be given of all three. A molded part can be sintered by placing green particulate material in a mold or cavity. The mold is first filled with the green constituent materials. Hard wear parts can be made. As an example, tungsten carbide or silicon nitride particles are packed into a mold or cavity. An interspersed particulate binder metal, typically a cobalt alloy, is added in the mold or cavity. In the past, extreme heat with deleterious consequences was applied in the ordinary manufacturing process along with extremely high pressure to form a molded part. The resultant part is a matrix of hard particles which are held together by the melted alloy. The alloy serves as a binder which holds the shape of the finished part. By applying an adequately high pressure to the cavity and by also applying an adequately high temperature for a desired interval, molded parts were made in this fashion. Such wear parts have extremely long life. Examples of such wear parts include teeth (sometimes known as inserts) used in drill bits, nozzles for directing a flow or stream of fluid, deflector plates, scuff plates and the like. This process completely avoids such manufacturing equipment, thereby reducing cost and improving speed of fabrication.

The finished products are formed in a conventional manner using extreme heat and pressure. By contrast, such molded products can be made using the microwave sintering apparatus and method set forth in the present disclosure. The particulate materials are tamped into a cavity at a desired packing density without requiring any extremely high pressures. The cavity is formed in a tube of material which is transparent to microwave radiation. This transparent tube is then positioned in the microwave cavity of the sintering apparatus. Sintering occurs at a more rapid temperature increase yet is consummated at a lower temperature level. Moreover, the grain size within the solid part does not grow as great as normally occurs in a conventional liquid sintering process. Improved hardness and chip resistance is obtained with a smaller grain structure in the molded part. The alloy sinters the entire particulate mass in the mold to thereby furnish a wear part. Examples of this will be given below.

The particulate or green material is shaped at room or ambient temperature in a mold, a preliminary process called "cold pressing". The tamped or pressed particles are shaped by a low cost cavity or mold. If the particles are sufficiently adhesive, the precast particles (without mold). can be sintered; if crumbling occurs, the low cast mold can be exposed to the microwave field to sinter the mold contents.

By the use of the process of the present invention, it is possible to prepare a new variety of extra hard, shaped parts at considerably lower temperature with smaller grain size, higher hardness and density. The process of the present invention also uses microwave sintering to obtain higher heating rates to form better conventional products. In the process of the invention, microwave heat is generated internally within the material instead of originating from external heating sources and is a function of the material being processed. As temperature increases above a point, the dielectric loss begins to increase rapidly and the sintered part begins to absorb microwaves more efficiently. This also raises the temperature. Hence, heating rates are as high as 300° C./minute. Both batch and continuous processing systems can be employed.

As a rule of thumb, the performance of the particulates with the same hardness, toughness and density improves with decrease in grain size. It is possible to achieve very small grain sizes with high hardness, toughness and density, using the microwave processes thereby improving the characteristics when compared to the conventional process. This process requires much lower temperature (less than about 1350° C.) than conventional sintering techniques (around 1500° C.).

QUICKLY SINTERED COMPONENTS HAVING REDUCED DIFFUSION OF ALLOYS

One aspect of the present procedure is the provision of a new class of molded parts. Collectively, these will be referred to hereinafter as molded composites. That term will be evident in like of the problems now set forth. Heretofore, sintering in conventional heating mechanisms has required the application of high pressure and high temperature (HPHT hereinafter) for long intervals. The HPHT approach typically involves excessive diffusion of the sintered materials thereby defeating changes or gradations in the finished product. Consider as an example drill teeth which are subjected to abrasion on the exposed outer end and shock loading. The two criteria have been met in the past by forming a polycrystalline diamond compact (PDC) layer which is mounted on the exposed or working end of a drill component where the body is made of tungsten carbide (WC). The PDC layer resists abrasion better than the WC body. However, the PDC layer is brittle and is subject to fracture, thereby failing completely in the event of fracturing. It is not uncommon for the PDC layer to chip or break completely. The shock loading is readily accommodated by the WC body. That is able to handle the shock in a better fashion. That is able to tolerate for longer intervals the shock loading that occurs in a repetitive fashion in tri-cone bill bits for drilling deep oil wells and in other circumstances. The manufacture of a PDC crowned insert involves the separate manufacture steps of making the PDC crown, the WC body, and then joining the two with a brazed connection. The brazing process creates a shear plane which is subjected to high stress concentrations, thereby running the risk of part failure by breaking off the PDC at the brazed joint. Better brazed joints can be obtained but at a serious cost of raised temperatures, etc. As the temperatures are raised for brazing, and better joints can be obtained with higher temperatures, there is an interlocking difficulty in that the PDC layer may be damaged by the excessive heat required for the brazing connection. There is also another problem which relates to the use of the binding material necessary to hold the PDC and WC layers together. This relates to the different concentrations of the binder. The binder is normally an alloy which is primarily cobalt. The cobalt alloy is typically included with different percentages of concentration. The brazed layer may have a concentration of 80% to 95% cobalt. The PDC and the WC layers may have concentrations which are moderately low but still quite different, perhaps one being 5% and the other being 20%. It is not possible because of cobalt diffusion to manufacture the cast PDC crowned WC insert body in a single heating using prior techniques to obtain the sintered product. This handicap derives from the fact that such a sintering process requires several hours of heat application. In that instance, an attempt to mold the PDC crown integrally with the WC body would not succeed because the long time interval enables cobalt diffusion during sintering so that the cobalt concentrations are distorted. Operating at the required conditions for twenty hours, the cobalt diffuses to provide a more or less uniform distribution of cobalt throughout the two regions. This ultimately places too much cobalt in one region by robbing the cobalt from the other region which then has too little cobalt. Separately, because of the long interval required for sintering, grain boundary additives are often added to the mix. While these boundary control additives may well provide that result, they do so with an overall weakening of the finished product. Simply stated, it is not as shock resistant or as hard as desired. This problem has been dealt with in the past by simply making PDC crowns in a separate manufacturing process. The body is made at another location in another process. The two components are then brought together and brazed. Then, the braze layer is formed to join the two parts together, yielding an interface between the two brazed parts with a very high stress concentration. Fortunately, the microwave process is relatively quick and the time interval is relatively brief so that cobalt diffusion deep into the two joined parts is held to a minimum. Also, stress concentration at the joint is avoided.

The present disclosure sets forth a way to accomplish this in a single molding step. In a mold cavity, the granular components that make up the PDC crown are tamped into the region and then the components making up the WC insert body are also placed in the cavity. The two sets of particles can be held together temporarily by sacrificial, volatile, binders such as some sort of wax or the like. The two sets of particles are regionally defined and yet can have an interface completely devoid of brazed material. The two regions, while having different concentrations of cobalt, are then jointly as a single unit sintered in accordance with this disclosure, thereby forming the desired product free of braze layer and yet which has regions with different cobalt concentrations. The sintering process is sufficiently brief that cobalt diffusion to an average distributed value of cobalt is avoided. Moreover, the grain size is held to a minimum, thereby improving the hardness of the molded part. Several examples will be given in the detailed description set forth below.

DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 2 shows a microwave sintered alumina grit in a microphotograph;

FIGS. 3 and 4 show different microwave sintered grit processed with different conditions;

FIG. 5 shows a mold or cavity in a tube;

FIG. 10 is a composite sintered body having an end located PDC layer, a WC body, and different concentrations of binding alloy in the body;

FIG. 11 is a view similar to FIG. 10 showing an alternate deployment of different concentrations of cobalt within the body;

FIG. 12 is a view similar to the foregoing drawings showing another arrangement of different concentrations of cobalt materials in the molded part;

FIG. 13 is an end view of the molded part of FIG. 12 showing the concentric arrangement of the components;

FIG. 14 is a view similar to FIG. 12 showing alternate concentrations of cobalt alloy in the body;

FIG. 15 is an end view of the molded part shown in FIG. 14;

DETAILED DESCRIPTION OF THE PREFERRED EMBODIMENT

Figure 1:
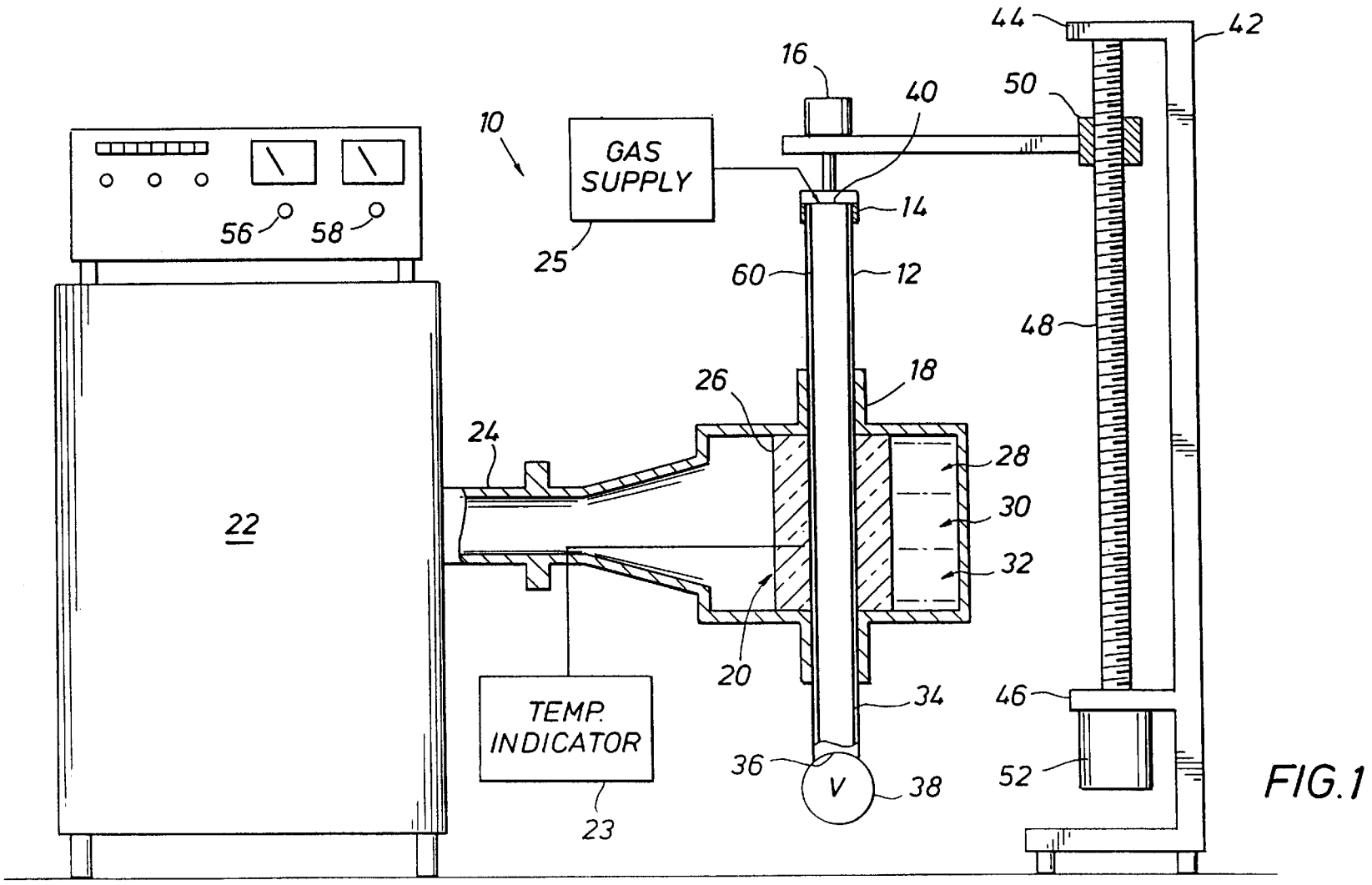
FIG. 1 is a system drawing of a microwave oven arrangement for reduced temperature sintering.

Going over the apparatus in FIG. 1 in some detail, the microwave system 10 incorporates a microwave generator 22 which forms the microwave radiation at some extremely high frequency which is conveyed by a wave guide 24 to the microwave cavity. The cavity is defined on the interior of an insulative sleeve 26. The sleeve 26 prevents heat loss through the tube 12 as will be explained. The microwave cavity communicates to the central area 20. In the central area, the material is heated in a first zone 28 and reaches the maximum or sintering temperature in an intermediate zone 30. Zone 30 is contiguous with the zone 28. As the product moves downwardly, it enters into the zone 32 where cooling begins. There is a discharge zone 34 at the lower end. The sintered material is delivered through the lower end 36. For the sake of controlling the flow rate, a valve 38 is affixed at the lower end to meter the delivered product. At the upper end, the tube is open at the top end 40 and the raw ingredients are introduced through the upper end. The collar or clamp 14 fastens on the exterior and preferably leaves the top end 40 open for material to be added. The clamp 14 holds the tube 12 for rotation when driven by the motor 16.

An adjacent upstanding frame 42 supports a protruding bracket 44 aligned with a bottom bracket 46. The brackets 44 and 46 hold a rotating screw 48 which serves as a feed screw. A movable carriage 50 travels up and down as driven by the screw. The screw 48 is rotated by the feed motor 52 shown at the lower end of the equipment. Rotation in one direction or the other causes the carriage 50 to move up or down as 20 the case may be.

The microwave system is provided with an adjustable power control 56 and a timer 58. The timer is used in batch fabrication while the system 10 is normally simply switched on for continuous sintering. Attention is momentarily diverted to one aspect of the tube 12. It preferably is a dual tube construction with a tube 60 fitting snugly inside the outer tube 12. This defines an internal cavity through which the porous particulate alumina is added at the top 40. It flows along the tube at a rate determined by the rate at which the valve 38 is operated so that the material is maintained in the hottest zone 30 for a controlled interval. For instance, the rate of flow down through the tube can be increased or decreased by throttling the flow through the valve 38. This assures that the material remains in the hottest portion 30 of the microwave cavity. By rotating the tube continuously and continuing a feed through the tube 12 which causes gradual downward linear motion, the particles are processed as appropriate by microwave sintering. By rotating without feeding the tube 12 through the cavity 20, but with controlled particulate flow through the tube 12 and valve 38, continuous sintering of a controlled flow can be done.

The microwave oven employed (equipped with a power control and a timer) produces microwave energy of 2.45 GHz frequency and power output of 900 W. The particulate material is placed in the closed insulating chamber, called the microwave cavity. The insulating material is an aluminum silicate based material. An inner sleeve 60 of porous zirconia is also included. The system reduces heat loss while maintaining high temperatures. A sheathed thermocouple is introduced for temperature measurement, and placed in the zone 30. This microwave oven procedure provides batch or continuous processing of alumina abrasive grains. For a continuous set-up, the material is added to the top of the tube 12 in the microwave field. The material for sintering is continuously fed from the top and sintered grains are drained at the bottom of the tube at a controlled rate. FIG. 1 shows a gas supply which can optionally flood the region of heated material and force oxygen out. This may reduce the risk of oxidation.

The particulate manufacturing process is set out in the examples given below which are provided by way of illustration only and should not be construed to limit the scope of this present invention. Several examples relate to processing loose particles, cold pressed particles in a mold, and cold pressed particles holding a shape without regard to shape and free of a mold.

MICROWAVE SINTERING SET-UP FOR PARTICLE PROCESSING

The starting materials came from Carborundum Universal Ltd., India. It consisted of sol-gel derived alumina grit with average particle size of about 0.6 to about 1 mm. The green grit is first dried at 90° C. for 24 hours in an electrical dryer, and is then packed into a high purity alumina tube (30 mm in diameter and 900 mm in length) 12 which is held by a metal clamp 14 and connected to the shaft of the rotating motor 16. The tube 12 is inserted into the microwave applicator 18 with a middle portion located in the central area 20 of the cavity. At the beginning, the tube is stationary in the original position and is held while rotating only, without vertical feeding movement. Microwave power is introduced to the applicator 18 and controlled to achieve a heating rate of 50° C./min. When the sample temperature reaches the set temperature, the feeding motor 22 is started to feed the tube at the desired speed (about 2 mm per min.). The temperature of the sample is monitored by an IR pyrometer (Accufiber Inc.), and is controlled by adjusting the incident microwave power. Sintering temperature and time can be varied from 1350° to 1500C and 5 to 45 minutes respectively. Parallel experiments from conventional furnace are reported to compare the results of the two processes.

The morphology and microstructure of the samples were characterized by SEM, the densities of the sintered samples were measured by the Archimedes method, and the Vickers hardness was measured by Micro indentation method.

The grit morphology of the starting and sintered particles is shown in FIG. 2. The shape of the particles did not change, but the average particle size of the sintered sample decreased about one third because of the shrinkage during the sintering. It was expected that the particles would bind together tightly after the sintering. However, the results showed that there was no or very weak bonding between the particles. The particles sintered at 1500° C. can be very easily separated by hand. This is important as it makes it possible to feed the green particles into the alumina tube continuously with the automatic feeder during the microwave sintering. Thus, processing of large amounts for commercial production can be achieved.

FIG. 3 shows the micro structures of the samples processed under different sintering conditions in microwave and conventionally. The starting particles are the agglomerates of very fine particles with average grain size of 50–100 mm. The sintered samples show an obvious grain growth. The grain size grew up to about 0.2 mm after being sintered at 1400C, and about 1.0 m at 1500° C. There are some pores in the sample sintered at 1400° C. These pores disappeared at higher sintering temperature (1500° C.). The density of the samples increased at the same time. Conventionally sintered samples under the identical conditions also show similar microstructure but with much higher porosity (see FIG. 4).

The quality of the microwave sintered particles mainly depends on the sintering temperature and time. During the continuous microwave sintering processing, the temperature is controlled by microwave power, and the sintering time (actually, this is the residence time of the samples in the high temperature zone) depends on the height of the high temperature zone and the feeding speed. Theoretically, higher feeding speed will lead to a higher product output, but has to be optimized for each material type to accomplish high quality products. The uniform high temperature zone is about 30 mm long in the microwave applicator. In this case, the residence time of the sample in the high temperature zone was about 15 minutes at a feeding speed of 2 mm/min.

Table 1 lists properties of sintered particles processed by conventional method and in the microwave field. The density of the samples increased with the longer sintering time or higher sintering temperature during the microwave sintering, but the conventionally sintered samples did not exhibit any substantial change in the density after processing above 1400C. It is also noted from these results that higher abrasive index and hardness values were obtained in microwave sintered samples.

TABLE 1

| | Sample No. | Sintering conditions | Microwave | Conventional |
|---|---|---|---|---|
| | VI | 1450° C. × 15 min. | 3.70 | 3.92 |
| | VIII | 1400° C. × 45 min. | 3.94 | 3.96 |
| | X | 1500° C. × 15 min. | 3.96 | 3.89 |
| Abrasion Index | VI | | 95 | 68 |
| | VIII | | 100 | 65 |
| | X | | 94 | 94 |
| Micro Vicker's Hardness ($Kg/mm^2$) | VI | | 2205 | 732 |
| | VIII | | 2387 | 1026 |
| | X | | 2316 | 1885 |

MOLDED PART MANUFACTURING

The apparatus shown in FIG. 1 has been described above as processing particulate green material which is input to the hollow tube thereby enabling the manufacture of sintered particles. In many instances, that satisfies the requirements of the sintering procedure. In this aspect, the sintering equipment is used to manufacture a molded or cast member. This is a product which has been made heretofore typically by high pressure, high temperature (HPHT) fabrication in a mold installed in a high pressure press. This uses two mold parts (male and female) which are brought together to define a mold cavity. The cavity is packed with particulate material including desired portions of selected carbides, nitrides or other hard particles and they are heated in the presence of a metal alloy which melts, thereby forming the requisite shaped or finished wear part. In the past, the mold had to be a heavy duty mold filled with the particulate green material and installed in a hydraulic press which applies very high pressures. In this novel approach, such pressures are not accomplished and therefore the expensive hydraulic press and mold are not needed. Accordingly, part of the present disclosure sets forth a method of manufacturing what might be termed cast or molded wear parts using a microwave sintering technique.

Attention is directed to FIG. 5 of the drawings which shows a replacement for the hollow tube shown in FIG. 1, more particularly, a tube-like construction is preferred to enable the tube to travel in linear fashion through the microwave cavity 20 as previously discussed. It is mounted in the same equipment as shown in FIG. 1, and is preferably advanced in a linear fashion. Rotation again is imparted by the motor 16. This distributes microwave heating more uniformly through the molded part. FIG. 5, therefore, illustrates a simple mold cavity in an elongate ceramic rod which can be divided into two parts so that it can be filled, thereby obtaining a cast or molded part. The shape of the finished part will be the same shape as the cavity.

FIG. 5 shows a simple mold for casting a tooth or insert for drill bits. The finished product is an elongate cylindrical body. FIG. 5 shows a solid ceramic tube 70. A plug 72 has a diameter to fit snugly in the axial passage 74. There is a cavity region at 76 shown in dotted line in FIG. 5. That region is the cavity in which the cast tooth or insert is made. Particulate material for the cast or molded tooth is put into the cavity 76. The plug 72 is fitted in the passage 74. Pressure is applied to pack down the material. While pressure is applied, the pressure that is necessary for this degree of packing is at least several orders of magnitude less than the pressures that are presently sustained in the manufacturing of such extra hard wear parts. The conventional manufacturing technique requires a hydraulic press with pressures of up to one million psi. In this instance, the pressure need only be sufficient to pack and force the material into a defined shape. The plug 72 is therefore pushed against the particulate material in the cavity 76. This defines the cast cylindrical part and the part when finished will have the shape of the cavity 76. For ease of extraction, it may be desirable to split the cylindrical body 70. In an alternative aspect, other shapes can be cast in the mold which may be formed of two or more pieces depending on the shape and complexity of the molded part. What is desired in this particular instance is that the conformed shape of the hard part is achieved by the mold, and that the cavity within the mold, as a preliminary step, be filled with the desired material.

To make such a wear part, the particulate material that is placed in the cavity is typically a hard metal carbide, nitride or other particulate material having extreme hardness. Tungsten carbide (WC) is the most common of these material although others are also known. In addition to that, a matrix of a cobalt based alloy is added. The other alloy components depend on the specifics of the requirements. Typically, the alloy is about 80 to 96% cobalt. The preferred alloy material is mixed in particulate form with the hard particles. When sintered, the particulate alloy will melt and seep into all the cervices and pores among the particles in the cavity and thereby form a binding matrix. The finished product will then have particles of extreme hardness held together in the alloy matrix.

In one aspect of the finished product, the alloy holds the particles together and this is especially true for both metal and ceramic particles. The term "cermet" has been applied to a mixed combination of materials including those made of ceramics and metals. The present procedure can be used to make a metal insert or other wear piece, and is also successful in casting cermets.

Whatever the case, the rod-like mold shown in FIG. 5 in inserted into the cavity in the fashion shown in FIG. 1. It is passed through the microwave cavity in a linear fashion if necessary. Optionally, rotation is applied to more evenly distribute the microwave radiation for even sintering. This enables sintering in a manner which provides improved characteristics for the finished product. This is one of the benefits of microwave sintering.

IMPROVED GRAIN STRUCTURE

One aspect of the apparatus of the present disclosure is the modification of the grain structure of the finished product. After sintering, the grain structure is quite different from that obtained from conventional heating procedures. As a generalization, cast parts are formed by application of very high pressure and temperature for a long interval. As a generalization, the grain structure tends to grow. To stop this, inhibitors are added. A desirable grain structure in accordance with the teachings of the present disclosure however contemplates grains which are under 1.0 micron in size without growth inhibitors. Even smaller grain structures such as 0.1 micron dimensions can be achieved through the use of the present disclosure. The subject invention therefore provides a greater reduction in grain size and the micro structure as observed by various investigation instruments (scanning electron microscope) is enhanced by reduction of grain size without the use of the required inhibitors restraining growth.

Common growth inhibitors include vanadium or chromium, or compounds involving these. When added, they do limit grain growth during sintering, but they also have undesirable side effects. They alter the physical characteristics of the finished product. In some regards, another grain growth inhibitor is obtained by adding titanium carbide or tantalum carbide. The addition of these two compounds (TiC) or (TaC) causes undesirable side effects as evidenced by a change in physical characteristics.

Trace additions of vanadium or chromium are particularly detrimental where the cast or molded part is to be subsequently joined to a polycrystalline diamond compact. They are typically joined to a tungsten carbide insert body for use in drill bits. The PDC is adhered in the form of a cap or crown on the end of the tungsten carbide based body. The tungsten carbide insert body is joined by brazing or other heating processes to the PDC crown. In doing that, the heating process tends to draw vanadium and chromium into the region of the PDC bond. The vanadium and chromium additives which otherwise inhibit grain growth have a detrimental impact on the PDC crown which is later adhered to the insert body, i.e., by brazing or otherwise. It is therefore highly undesirable to incorporate such grain growth inhibitors.

Through the use of the present disclosure, a smaller grain can be achieved without addition of vanadium or chromium. This enables the fabrication of a substantially pure insert body (by that, meaning that it has no vanadium or chromium or other PDC poisons in it), thereby enabling an enhanced construction of a PDC crown insert body. The present disclosure therefore provides an insert body which can be subsequently joined to the PDC crown.

REDUCED COBALT DIFFUSION

Figure 6:
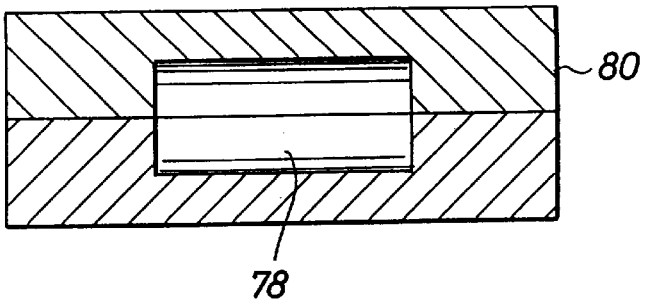
Figure 7:
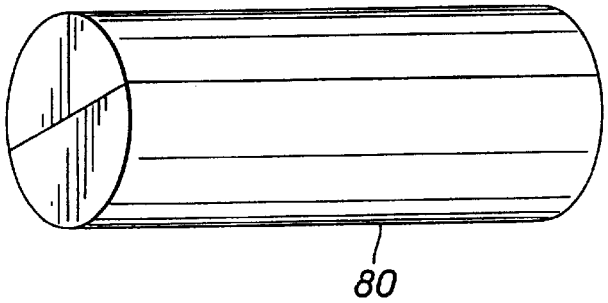

Attention is first directed to FIGS. 6 and 7 where a mold cavity 78 is shown in a two-piece mold 80. Conveniently, the mold 80 is in the form of the rod shown in FIG. 7. This enables the rod 80 to be advanced through the microwave chamber shown in FIG. 1 for sintering. As will be understood, the rod 80 can be of any length and therefore it can hold one or more such cavities. It is shown comprised of two mold pieces which divide and separate. This enables the cavity to be filled. It is filled with particles which can be loosely packed in the cavity. It is not necessary that the mold pieces divide precisely on the diameter of the rod 80. Therefore the cavity can be exposed for easy filling in this approach, or filling in the fashion shown in FIG. 5. It will be understood that there are many techniques for filling mold cavities with particulate material prior to microwave sintering to form the finished product. In any event, the rod 80 functions as a mold cavity and is constructed so that it progresses through the equipment shown in FIG. 1. This typically involved rotation of the rod 80 to distribute the microwave energy substantially evenly through the parts being made in the cavity. Again, the rod is also moved in a linear fashion through the equipment so that a specific dwell time in the microwave energy field is obtained. The rod 80 may have one or several cavities in it. If many, the rod is moved in the illustrated fashion through the equipment so that all of the cavities are exposed for full sintering.

Figure 8:
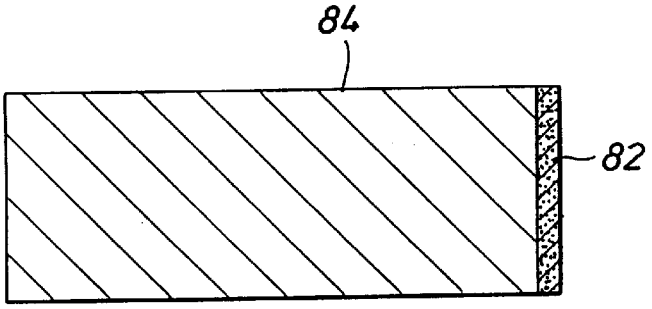
FIG. 8 is a sectional view through a sintered wear part having an extra-hard PDC layer at one end and a WC body.

Going now to FIG. 8 of the drawings, a simple cylindrical drill tooth or insert is shown. In this particular instance, it is provided with a PDC layer 82 adjacent to a WC body 84. The PDC layer is formed of small industrial grade bits of diamonds which are mixed with a binder. The binder is a cobalt based alloy and is mostly cobalt. The WC body is likewise a set of WC particles which are held together in a cobalt alloy. The two components are each provided with different concentrations or amounts of cobalt. The binding alloy itself is typically in the range of 80% to about 95% cobalt; there is however a difference in the amount of cobalt alloy material in the two regions. FIG. 8 shows the PDC layer 82 as a definitive covering which has a sharply defined interface. In the past, that has been an inherent aspect of manufacture of these two components in separate procedures where they are then joined by brazing. This definitive interface has been the source of problems. On the one hand, it is desirable to have such a sharply defined interface in that the cobalt concentrations have to be different on the two sides of the interface. It has been detrimental on the other hand in that the joiner of the two materials creates stresses which remain after cooling. Even worse, the two regions have different thermal expansion rates. That sometimes creates even greater internal stresses dependent on the ambient temperature of the device. Suffice it to say, this sharply defined interface that has prevailed in the past was a direct result of manufacture of the PDC layer 82 separate and remote from the WC body 84 and thereafter joining the two at the sharply defined interface. By using the approach taught herein, the particles for the diamond layer 82 along with the binding cobalt alloy necessary to hold it together are placed in the mold, and the particles for the WC body are also placed in the mold. The interface is not as sharply defined and it can be irregular in that the particles are irregular in shape and packing. Conveniently, the particles can be held together with a volatile wax which is driven off by heating. This serves as a simple sacrificial binder which is completely ejected from the mold cavity during heating. Indeed, the mold pieces need not join so tightly that they define an air tight chamber. Thus the binding wax can be readily applied to the loose particles to hold them ever so slightly prior to placing the particles in the cavity. With or without a binding wax, the particles are placed in the mold cavity and are subsequently sintered. The finished product is shown in FIG. 8 and comprises the PDC layer 82 which is sintered simultaneously with the WC body 84 so that the two are joined together. The bond between the two is sufficient to hold the PDC crown on the insert body so that it does not readily break or separate. Stress concentration at the interface is markedly reduced.

Figure 9:
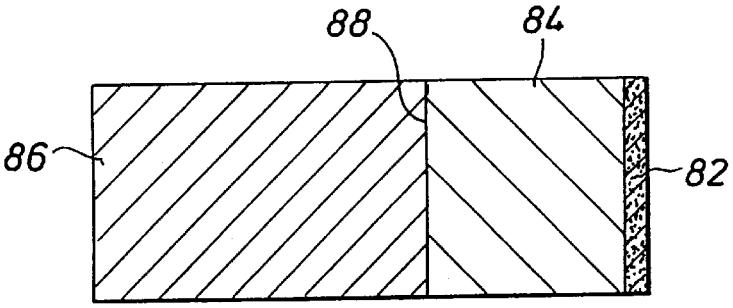
FIG. 9 is a similar wear part as that shown in FIG. 8 which is formed with multiple layers.

Going now to FIG. 9 of the drawings, an alternate form of this is shown. Again, the PDC crown 82 is joined to the WC body 84. The body 84 is shorter than that shown in FIG. 8 and the remainder of the body is formed of WC material 86 having different structural characteristics. This can be obtained by changing the concentration of the WC, change of grain size, and other factors. In this particular instance, a braze layer 88 is located in the assembled insert. The braze layer 88 defines a joint between the layers 84 and 86. In FIG. 9, there are therefore four different layers and each will have a different concentration of cobalt. The concentrations of cobalt can range from 90% or 95% at a maximum in the braze joint. While it is thin, it is sandwiched between two materials which are also made with a binding cobalt alloy but it is present in markedly reduced concentrations. Thus, the layer 88 might be a few mills thick flanked on both sides by quite thick layers of WC based material where cobalt is present in concentrations of 6% and 18% as exemplary values. Through the microwave sintering process, the relative cobalt concentrations are maintained without the cobalt diffusing over the long time interval otherwise involved in conventional sintering. This preserves the value of the cobalt bonding material and the different regions.

FIG. 10 is similar to FIG. 9 but shows even another aspect. In this particular aspect, the body portion 90 is made with 6% cobalt while the body portion 92 is made with 15% cobalt. Again, assuming that the braze layer is made with 90% or more cobalt, one will readily observe that there are several regions with different cobalt concentrations. In particulate form, the cast member shown in FIG. 10 is assembled by first placing the particles in the mold cavity, and the particles are put in the cavity with the illustrated distribution therein. While sintering, the finished product becomes a composite of the materials shown in FIG. 10 but there is markedly reduced diffusion throughout the body. Rather, the relatively different cobalt concentrations are preserved in the various regions.

FIG. 11 is similar to FIG. 10 and again shows different cobalt concentration regions. The regions have different geometric shapes in FIG. 10 compared with FIG. 11. Again after sintering, the finished product preserves the regional distribution and does not create sufficient diffusion that the resulting amalgam looses the regional concentrations that otherwise provide strength. It will be further understood, the shape of the regions 90 and 92 is defined by the specific needs in manufacture of the insert.

FIG. 12 shows yet another arrangement. As shown in the end view of FIG. 13, the two portions 90 and 92 are deployed concentrically. The region 92 defines a central core which is then fully surrounded by the 6% cobalt region 90. Again as before, this is bonded to the other components as previously mentioned. Again, after sintering, the geometric shapes are relatively well preserved. This is especially useful as a roller bearing element. The different characteristics of the regions 90 and 92 enable wear to be accommodated in an improved fashion.

Going next to FIGS. 14 and 15 of the drawings, the regions 90 and 92 are shown in FIG. 15 which depicts the transverse planar region 92 extending fully across the diameter of the cylindrical piece.

Figure 16:
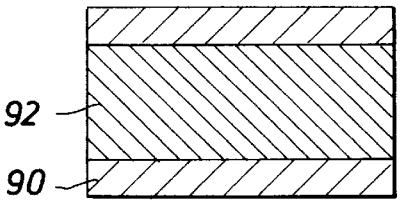
FIG. 16 is yet another alternate molded part showing different concentrations of cobalt in the molded part.
Figure 17:
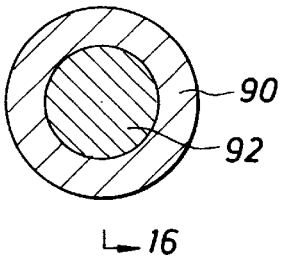
FIG. 17 is an end view of the molded part shown in FIG. 16.

FIGS. 16 and 17 are similar to FIG. 14 in that the 15% cobalt material defines the center piece while the 6% cobalt material defines the outer region 90. Again, after sintering, the geometric shapes are preserved and the cobalt does not diffuse and become distributed.

Figure 18:
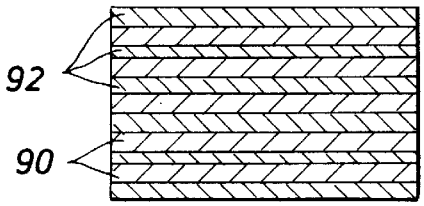
FIGS. 18 and 19 show a molded part which differs from that shown in FIGS. 16 and 17.
Figure 19:
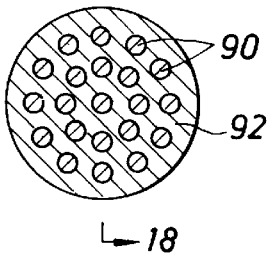

FIGS. 18 and 19 show yet another deployment of the components. Here, the 6% cobalt material is defined as a set of small rods which are encircled by the 15% cobalt material. The rods are approximately parallel and distributed evenly. The several rods extend from face to face along the full length of the body as illustrated.

Figure 20:
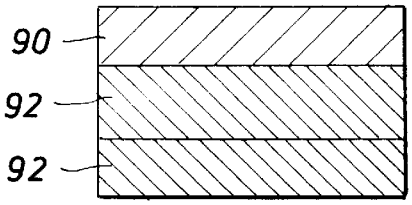
FIGS. 20 and 21 together show another form of molded part.
Figure 21:
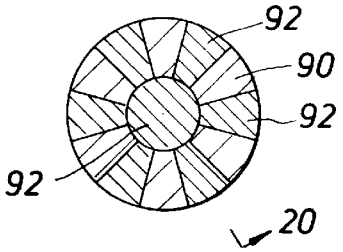

FIGS. 20 and 21 show rod-like members extending along the molded part. Rather than being circular rods, they are wedge-shaped portions as illustrated in the end view of FIG. 21.

Figure 22:
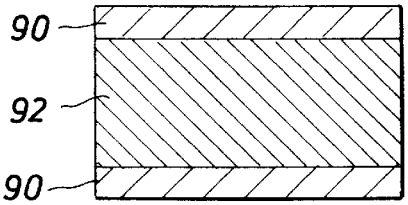
FIGS. 22 and 23 show a different form of molded part.
Figure 23:
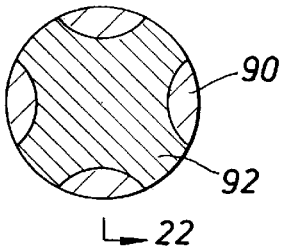

Continuing the deployment of the two materials in FIGS. 22 and 23 is best illustrated in FIG. 23. This is especially useful in providing side wall reinforcing for drill bit inserts which are subjected to scuffing from the side. This helps resist the laterally directly wear.

Figure 24:
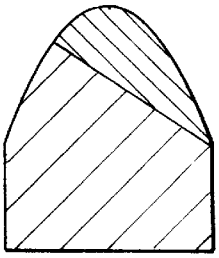
FIGS. 24–26 show differing configurations of molded teeth having different concentrations of cobalt.
Figure 25:
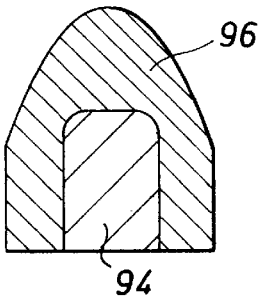
Figure 26:
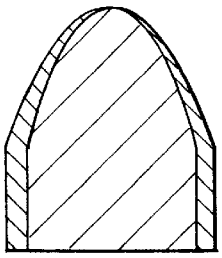

FIGS. 24–26 show various teeth for use in drill bits and the like. Again, these are molded and shaped utilizing the microwave sintering process of the present disclosure. Different concentrations of cobalt material are illustrated. As before, the cobalt concentration at 94 corresponds to the 6% cobalt concentration region 90 shown in FIG. 10 and other views following. The high concentration region 96 is typified with a 15% cobalt concentration used in the examples given herein. As will be observed in the six different molded teeth, the several regions are capable of having different shapes and yet provide the type of interface between the two regions where the cobalt in the two regions is not significantly diffused across the interface. The six teeth do not suffer the infirmities of HPHT processing in which the resultant component substantially equalized cobalt concentration in all regions. Moreover, the grain size is kept small in accordance with the present disclosure. The small grain size has the advantages mentioned heretofore namely that the cobalt does not so readily diffuse that regional differences are lost during sintering.

ENHANCED SINTERED GRAIN SIZE

One aspect of the present disclosure is the provision of grains which have a desired minimal size. As noted, larger grain size is generally associated with the loss of desirable physical characteristics. Heretofore, grain growth inhibitors have been required. As mentioned, one such inhibitor is vanadium which is added to limit grain growth. That is detrimental and especially so in conventional heating procedures where the grain growth is undesirable. Grain growth ideally should be limited so that the grains are relatively small, typically about 2 microns or less. Heretofore, another grain growth inhibitor has been the addition of a small amount of TiC or TaC. The sintering process of this disclosure avoids the necessity for TiC or TaC additives. This therefore enables the fabrication of parts having grain sizes in the area of about 2 microns down to 0.6 microns or smaller.

The foregoing is especially applicable to cast parts which are formed of WC, diamond, CBN and other composite materials such as PDC as mentioned.

While the foregoing is directed to the preferred embodiment, the scope thereof is determined by the claims which follow.

We claim:

1. A method of preparing sintered particles comprising the steps of:

(a) putting green particles into an elongate hollow tube having an axial passage therethrough to enable flow of the particles through the tube in the axial passage along the tube from an inlet to an outlet of the tube;

(b) forming microwave energy radiation directed into the tube to cause heating of the particles in the tube; and (c) moving the particles along the tube relative to the microwave radiation so that the radiation acts on the particles in a controlled fashion to thereby heat and sinter the particles.

2. The method of claim 1 including the step of positioning an insulative sleeve around a portion of the tube to retain heat within the tube so that heat loss to the exterior of the tube is reduced and to confine the heat in the region of the tube, and controllably releasing the sintered particles from the outlet of the tube while adding green particles at the inlet of the tube.

3. The method of claim 1 wherein the particles in the tube are relatively rotated with respect to the microwave radiation.

4. The method of claim 3 wherein the particles in the tube move linearly through the microwave radiation.

5. The method of claim 4 including the step of mounting the tube on a motor driven rotating support to impart tube rotation.

6. The method of claim 5 including the step of mounting the tube on a support moving the tube linearly in response to operation of a second motor.

7. The method of claim 6 including the step of controlling particulate flow through said tube by controllably opening a valve at said outlet to control flow therethrough.

8. The method of claim 1 fabricating an insert body for attachment to a PDC insert comprising the added steps of:

(a) closing said outlet thereby forming a mold cavity from said tube and moving said cavity relative to said microwave radiation;

(b) placing the green particles in said cavity by filling the cavity with hard metal particles in the presence of a homogeneously mixed particulate binding matrix;

(c) sintering with the microwave radiation to form a unitary body having the shape defined by the cavity wherein the sintered matrix binds hard metal particles having a specified microstructure grain size;

(d) thereafter attaching a PDC insert to the cast body;

(e) wherein the body is made free of grain growth inhibitors; and (f) the grain size in the cast body is less than about 2 microns.

9. The method of claim 8 wherein the metal particles have the specified microstructure grain size prior to sintering, and wherein they are sintered to form a hard metal body having a resultant grain size, said PDC insert.

10. The method of claim 8 wherein the sintering step comprises microwave sintering, and the hard metal particles are provided with a particle size of less than about 2 microns.

11. The method of claim 8 wherein binding matrix about 80% to 96% cobalt, and said sintering step comprises microwave sintering so that said unitary body comprises sintered hard particles retaining an initial grain size.

12. The method of claim 11 wherein said hard body and said PDC insert have initial different cobalt concentrations prior to sintering, and the different cobalt concentrations are preserved after sintering.

13. The method of claim 12 wherein said PDC insert is sintered simultaneously with said body.

14. A method of claim 1 for fabricating a cast part comprising the steps of:

(a) closing said outlet thereby forming a mold cavity from said tube and moving said cavity relative to said microwave radiation;

(b) defining the shape of the finished cast part in said cavity;

(c) placing the green particles in the cavity to define two regions within the cavity having differing characteristics based on differing types of green particles placed therein; and (d) sintering with the microwave radiation to form a unitary body within said cavity and having a shape defined by the cavity wherein the sintered particles define regions within the unitary body preserving the differing characteristics.

15. The method of claim 14 wherein said step of placing particles in the cavity includes the step of placing alloy particles at different concentrations to define the differing characteristics; and the sintering step comprises microwave sintering.

16. The method of claim 15 wherein the alloy particles comprise cobalt and the concentration of cobalt is different in at least two regions.

17. The method of claim 15 wherein one region is defined by hard particles, and a second region is defined by brittle particles.

18. The method of claim 1 for forming a wear part of unitary construction comprising the steps of:

(a) closing said outlet thereby forming a mold cavity from said tube and moving said cavity relative to said microwave radiation;

(b) defining the shape of the wear part by the shape of said cavity;

(c) placing the green particles in the cavity of the mold so that the particles in the cavity in the mold define first and second regions having differing characteristics;

(d) microwave sintering to form a unitary body having a shape defined by the cavity in the mold wherein the sintered particles form a unitary body; and (e) wherein the sintering step joins the first and second regions with the differing characteristics.

19. An apparatus for sintering loose particles comprising:

(a) an elongate hollow tube formed of a material which is transparent to microwave radiation;

(b) an inlet at one end of the tube to enable green particles to be placed in the tube, and further including a passage therethrough communicating to a tube outlet;

(c) an insulative sleeve surrounding said tube wherein the sleeve defines a heating zone;

(d) a microwave generator;

(e) a wave guide connected from the generator to form a radiation cavity surrounding and coupled with the tube so that radiation from the microwave generator is coupled through the wave guide and into the cavity which includes the heating zone of the tube; and (f) means for providing relative movement between the microwave radiation and the particles in the tube so that the particles have a specified dwell time in the heating zone and are held in the heating zone for an interval sufficient to be converted from green particles into the sintered particles.

20. The apparatus of claim 19 including a motor connected with a drive mechanism coupled to the tube so that the tube is moved in a controlled fashion and at a controlled rate.

21. The apparatus of claim 20 further including a valve connected to the outlet end of said tube to control the flow of sintered particles from the tube so that the flow rate assures adequate exposure in the heating zone.

22. The apparatus of claim 20 wherein said motor rotates said tube.

23. The apparatus of claim 22 including a second motor connected with a drive mechanism coupled to said tube to move said tube linearly at a controlled rate.

24. The apparatus of claim 23 wherein said motor connects to a feed screw to relatively move a traveling carriage therewith.

25. An apparatus for sintering a molded piece, comprising:

(a) an elongate tube having a cavity for receiving green unsintered particles therein;

(b) an insulative sleeve surrounding said tube wherein the sleeve defines a heating zone;

(c) a microwave generator;

(d) a wave guide connected from the generator to form a radiation cavity surrounding and coupled with the tube so that radiation from the microwave generator is coupled through the wave guide and into the cavity which includes the heating zone of the tube; and (e) means for providing relative movement between the microwave radiation and the particles in the tube so that the particles have a specified dwell time in the heating zone and are held in the heating zone for an interval sufficient to be converted from green particles into the sintered particles.

26. The apparatus of claim 25 wherein said tube cavity is filled to a low pressure and closed by a plug.

27. The apparatus of claim 26 wherein said plug and said tube define the shape of the molded piece.

28. The apparatus of claim 27 including a motor connected with a drive mechanism coupled to the tube so that the tube is moved in a controlled fashion and at a controlled rate.

29. The apparatus of claim 28 including a second motor connected with a drive mechanism coupled to said tube to move said tube linearly at a controlled rate.

30. A method of preparing a shaped hard body comprising the steps of:

(a) defining green particles comprising a first green particle material and a second green particle material into a desired finished hard body shape, wherein (i) said first green particle material comprises a first binder homogeneously mixed therein, (ii) said second green particle material comprises a second binder homogeneously mixed therein, and (iii) said first and second binders comprise a common element in differing concentrations;

(b) moving the shaped green particles through microwave energy radiation to cause heating wherein the radiation acts on the particles in a controlled fashion to sinter the particles into a unitary body.

31. The method of claim 30 wherein the unitary body after sintering is formed with regions having differing physical characteristics without loss of regional characteristics.

32. The method of claim 31 wherein the unitary body comprises a PDC insert in a hard metal body having a supportive matrix.

* * * * *